US012546073B2

(12) United States Patent
Mcintosh

(10) Patent No.: US 12,546,073 B2
(45) Date of Patent: Feb. 10, 2026

(54) ICE LEVELING SYSTEM

(71) Applicant: Latec Machine Control Inc., Exeter (CA)

(72) Inventor: Robert James Mcintosh, Exeter (CA)

( * ) Notice: Subject to any disclaimer, the term of this patent is extended or adjusted under 35 U.S.C. 154(b) by 427 days.

(21) Appl. No.: 18/135,850

(22) Filed: Apr. 18, 2023

(65) Prior Publication Data

US 2023/0340739 A1 Oct. 26, 2023

Related U.S. Application Data

(60) Provisional application No. 63/332,754, filed on Apr. 20, 2022.

(51) Int. Cl.
*E01H 4/02* (2006.01)

(52) U.S. Cl.
CPC ..... *E01H 4/023* (2013.01)

(58) Field of Classification Search
CPC .. E01H 4/023; E01H 5/07; E02F 3/847; E02F 3/842; G01C 15/004; E01C 19/006
See application file for complete search history.

(56) References Cited

U.S. PATENT DOCUMENTS 2,763,939 A * 9/1956 Zamboni ..... E01H 5/07 37/219
4,820,041 A * 4/1989 Davidson ..... G01S 5/16 33/294
6,029,752 A 2/2000 Young
6,450,267 B2 * 9/2002 Ohtomo ..... G05D 1/0236 701/50
6,948,267 B2 * 9/2005 Pirila ..... E01H 4/023 172/779
7,510,247 B2 3/2009 Pirila
9,062,425 B2 * 6/2015 Schlupp ..... E01H 4/023
2006/0226695 A1 * 10/2006 Pirila ..... E01C 19/006 299/24
2012/0012350 A1 * 1/2012 Kamizono ..... E02F 3/847 356/622
2018/0149478 A1 5/2018 Jung

FOREIGN PATENT DOCUMENTS

CA 2446816 C 7/2009
CN 207703213 U 8/2018
JP H1151616 A 2/1999

* cited by examiner

*Primary Examiner* — Christopher J Sebesta
*Assistant Examiner* — Blake E Scoville
(74) *Attorney, Agent, or Firm* — Brunet & Co. Ltd.; Robert Brunet; Hans Koenig

(57) ABSTRACT

An ice leveling system involves a laser receiver mountable on an ice conditioning head of an ice resurfacing machine below a top-most portion of the ice resurfacing machine and at least two laser projectors that project laser light in a plane below a level of the top-most portion of the ice resurfacing machine. The at least two laser projectors are mountable adjacent to an ice surface and are positionable around the ice surface so that the laser receiver when mounted on the ice resurfacing machine always receives the laser light from at least one of the at least two laser projectors during an ice leveling operation. At least one of the at least two laser projectors is height adjustable to align the laser light plane projected by the height adjustable laser projector with the laser light plane of others of the at least two laser projectors.

11 Claims, 8 Drawing Sheets

ICE LEVELING SYSTEM

CROSS-REFERENCE TO RELATED APPLICATIONS

This application claims the benefit of U.S. Provisional Patent Application 63/332,754 filed Apr. 20, 2022, the entire contents of which is herein incorporated by reference.

FIELD

This application relates to ice resurfacing machines, more particularly to a laser-guided system for leveling ice with an ice resurfacing machine.

BACKGROUND

Ice levelling systems for use with ice resurfacing machines currently utilize a long pole mounted to the ice resurfacing machine with a laser receiver mounted to the top of the pole well above a top-most portion of the ice resurfacing machine. A laser projector is located above the glass surrounding an ice rink, the laser projector projecting a plane of laser light horizontal to the ice surface. However, operators of the ice resurfacing machines have a tendency to drive the ice resurfacing machines into low height garages without lowering the pole, causing the pole and/or the laser receiver to become damaged and the system to become inaccurate.

U.S. Pat. No. 9,062,425 issued Jun. 23, 2015 describes a support mount for laser-guided ice resurfacing machines in which a mast is mounted on the ice resurfacing machine and a laser is mounted above the dasher boards of the rink. The mast is height adjustable.

CA 2,446,816 issue Jul. 14, 2009 describes a support mount for laser-guided ice resurfacing machines in which a measuring rod is mounted on the ice resurfacing machine and a laser is mounted above the dasher boards of the rink. The measuring rod is height adjustable.

U.S. Pat. No. issued Mar. 31, 2009 describes a support mount for laser-guided ice resurfacing machines in which a bar is mounted on the ice resurfacing machine and a laser is mounted above the dasher boards of the rink. The bottom of the bar rides on the ice and moves up and down with changes in the level of the ice surface.

There remains a need for an alternate ice leveling system whereby damage to the laser receiver and/or laser receiver mount caused by driving the ice resurfacing machine into a low height garage is avoided.

SUMMARY

An ice leveling system comprises: a laser receiver mountable on an ice conditioning head of an ice resurfacing machine below a top-most portion of the ice resurfacing machine; and, at least two laser projectors that project laser light in a plane below a level of the top-most portion of the ice resurfacing machine, the at least two laser projectors mountable adjacent to an ice surface to be leveled, the at least two laser projectors positionable around the ice surface so that the laser receiver when mounted on the ice resurfacing machine always receives the laser light from at least one of the at least two laser projectors during an ice leveling operation with the ice resurfacing machine, at least one of the at least two laser projectors being a height adjustable laser projector to align the laser light plane projected by the height adjustable laser projector with the laser light plane of others of the at least two laser projectors.

A method for leveling ice on an ice surface to be leveled comprises: operating an ice resurfacing machine on the ice surface to be leveled, the ice resurfacing machine having a laser receiver mounted on an ice conditioning head of the ice resurfacing machine below a top-most portion of the ice resurfacing machine; projecting at least two aligned laser light planes horizontal to the ice surface in a plane below a level of the top-most portion of the ice resurfacing machine, the laser light from at least one the laser light planes being received by the laser receiver irrespective of the position and orientation of the ice resurfacing machine on the ice surface; and, controlling a height of the ice conditioning head during operation of the ice resurfacing machine so that the laser receiver is always receiving the laser light from at least one of the planes of the projected laser light.

Aligned laser light planes are horizontally oriented laser light planes that are parallel to the ice surface at the same height above the ice surface. When the laser light planes are aligned, the laser light planes are essentially coplanar. When the laser light planes are aligned with the laser receiver the laser receiver is situated at a height above the ice surface whereby the laser receiver is able to detect the laser light being projected by the laser projectors. The laser light planes are preferably horizontal to the ice surface and are aligned horizontally.

The laser receiver is mounted on the ice resurfacing machine below a top-most portion of the ice resurfacing machine. The top-most portion of the ice resurfacing machine is the portion of the machine at the greatest height above the ice surface that can interfere with or entirely block the laser receiver from receiving one or more of the laser light planes. The laser receiver is mounted on the ice conditioning head of the ice resurfacing machine, which is at a rear of the ice resurfacing machine behind the operator. Thus, the laser receiver is mounted below a level of most of the machine and the entirety of the ice resurfacing machine in front of the operator can block or interfere with the laser light being projected from the laser projectors. Where dasher boards surround the ice surface, the laser receiver is preferably mounted at a height lower than a top of dasher boards, which is usually up to about 120 cm from the ice surface. The laser receiver is preferably mounted on the ice resurfacing machine at a height in a range of 30-100 cm from the ice surface.

The ice leveling system comprises at least two laser projectors, for example 2, 3, 4, 5, 6 or more laser projectors. Because the laser receiver is mounted on the ice resurfacing machine below a top-most portion of the ice resurfacing machine, the laser projectors are also positioned to project the laser planes in a single level plane at the same height above the ice surface as the laser receiver below the top-most portion of the ice resurfacing machine. Preferably, the number of laser projectors is the fewest possible for the configuration of the ice surface while still ensuring that the laser receiver can, at all times, detect the laser light from at least one of the laser projectors irrespective of the position and orientation of the ice resurfacing machine on the ice surface. Using the fewest number possible of the laser projectors reduces the cost and complexity of the system, and reduces the difficulty of keeping all of the laser planes aligned. Preferably, the at least two laser projectors consist of two laser projectors. The laser projectors may be located anywhere around the ice surface provided that the laser receiver can, at all times regardless of a direction of travel of the ice resurfacing machine, detect the laser light from at least one of the laser projectors. Thus, at least one of the laser light planes should not be in the shadow of the ice resurfacing machine regardless of the direction of travel of the ice resurfacing machine. For example, two laser projectors situated opposite each other at the edges of an oblong ice surface (e.g., in a hockey rink) would be sufficient. Preferably, the two laser projectors are situated in diagonally opposite corners of the ice surface. In some embodiments, the at least two laser projectors comprise a first laser projector and a second laser projector, and the first laser projector is mounted at a first corner of the ice surface diagonally opposite the second laser projector mounted at a second corner of the ice surface.

At least one of the at least two laser projectors is height adjustable to be able to align the laser light plane projected by the height adjustable laser projector with the laser light plane of others of the at least two laser projectors. Adjusting the height of the laser projector adjusts the height of the projected laser light plane above the ice surface. The laser light plane is preferably horizontal, i.e., parallel to the ice surface, so when the height of the projected laser light plane is aligned with the height of the laser receiver from the ice surface, the laser receiver can detect the projected laser light from most positions of the ice resurfacing machine on the ice surface, provided the ice resurfacing machine is not itself blocking the laser light plane. Frequent re-alignment of the projected laser light planes, perhaps as often as each time the ice resurfacing machine is brought out to resurface the ice, is usually required because the dasher boards move during game play (e.g., a hockey game) and can be taken in and out for special events occurring in the same venue. Preferably, all of the at least two laser projectors are height adjustable to provide more flexibility for re-alignment of the projected laser light planes. The laser receiver may also be height adjustable to facilitate re-alignment of the laser light planes projected from the laser projectors.

Height adjustment of the laser projectors (and the laser receiver, if desired) may be accomplished automatically by an electronic controller, manually by a human operator or electronically through the electronic controller initiated by a human operator. Preferably, height adjustment of the laser projectors (and the laser receiver, if desired) is accomplished remotely through a remote controller. The remote control may be operated by a human or may be programmed with software to automatically adjust the height of the laser projectors when the ice leveling system is switched on. Preferably, the remote controller is configured to automatically control the height of the height adjustable laser projector above the ice surface in order to align the laser light planes projected by all of the laser projectors with each other and with the laser receiver.

In some embodiments, the height adjustable laser projector is height adjustable by being mounted on a height adjustable mount. The height adjustable mount preferably comprises a telescoping pedestal. The telescoping pedestal is preferably operated by an actuator, for example and electric, hydraulic or pneumatic actuator, mounted on the pedestal. Other designs of a height adjustable mount may be contemplated, for example screw-based mounts, elevator-style mounts, mounts with sprocket and chain actuators, and the like.

In some embodiments, the ice leveling system further comprises at least two dasher boards for the ice surface. Each of the dasher boards comprise an opening through which the laser light plane is projectable from one of the at least two laser projectors during the ice leveling operation. Each of the dasher boards preferably comprise a movable door plug configured to open and securely close the opening. The at least two laser projectors may be mounted adjacent, preferably behind, the at least two dasher boards so that the laser light planes are projectable from the laser projectors toward the laser receiver through the openings when the door plugs are opened. Thus, the opening in the dasher board is below the top of the dasher board and the laser projectors are protected by the dasher boards from activity on the ice surface. The remote controller may be configured to automatically control a height of the height adjustable laser projector above the ice surface in order to align the laser light planes projected by all of the laser projectors with each other and with the laser receiver and to automatically open and close the door plugs. At this time, the remote controller is configured to be operated by an operator to control the height of the height adjustable laser projector above the ice surface.

The ice leveling system may be controlled by controlling each part of the system manually. However, the ice leveling system is preferably controlled remotely from a single location. The system may be wholly automated using a programmed controller in electronic communication with electronic parts of the system, for example the laser projectors, various actuators and various sensors (including the laser receiver), but in some embodiments, the system is controlled remotely by a human operator using a remote control subsystem in electronic communication with the electronic parts. The human operator may be located on the ice resurfacing machine, in a booth associated with the ice surface or even in a completely different location, in which case cameras, other sensors and computers could be included in the system and the system electronically connected to a computer network to provide the remote operator with the necessary data to operate the system. In a preferred embodiment, the remote controller is located on the ice resurfacing machine so that the operator of the ice resurfacing machine can also operate the ice leveling system. However, it is also preferable to configure the remote controller to automatically control a height of the height adjustable laser projector, more preferably to automatically control a height of the height adjustable laser projector and to open and close the openings in the dasher boards. Electronic communication between the remote controller and electronic parts of the system may be accomplished wirelessly, through wired connections or by a combination thereof.

Further features will be described or will become apparent in the course of the following detailed description. It should be understood that each feature described herein may be utilized in any combination with any one or more of the other described features, and that each feature does not necessarily rely on the presence of another feature except where evident to one of skill in the art.

BRIEF DESCRIPTION OF THE DRAWINGS

For clearer understanding, preferred embodiments will now be described in detail by way of example, with reference to the accompanying drawings, in which.

DETAILED DESCRIPTION

Figure 1:
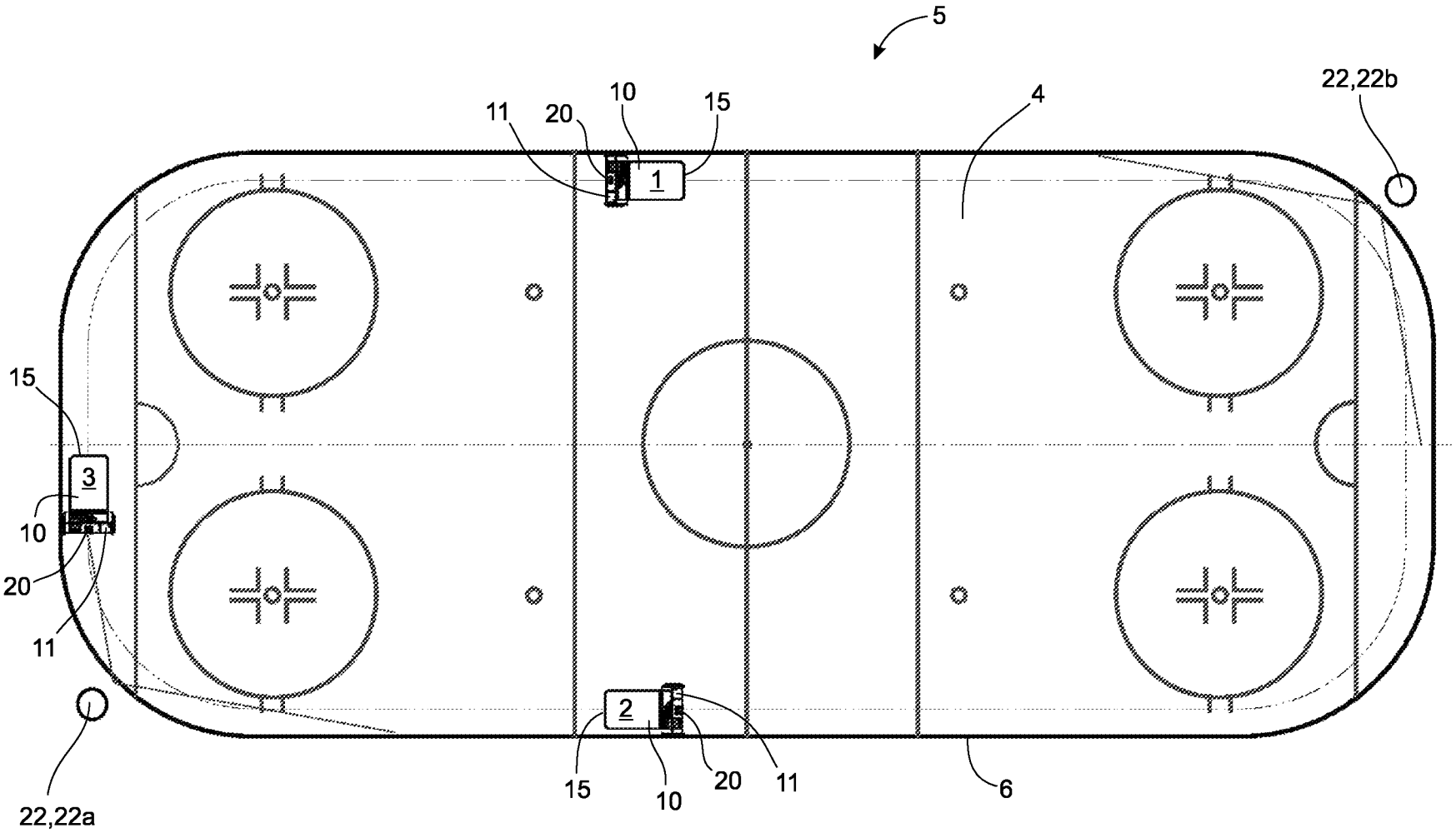
FIG. 1 depicts a top view of an ice leveling operation with an ice resurfacing machine in a hockey rink using an ice leveling system of the present invention.
Figure 2:
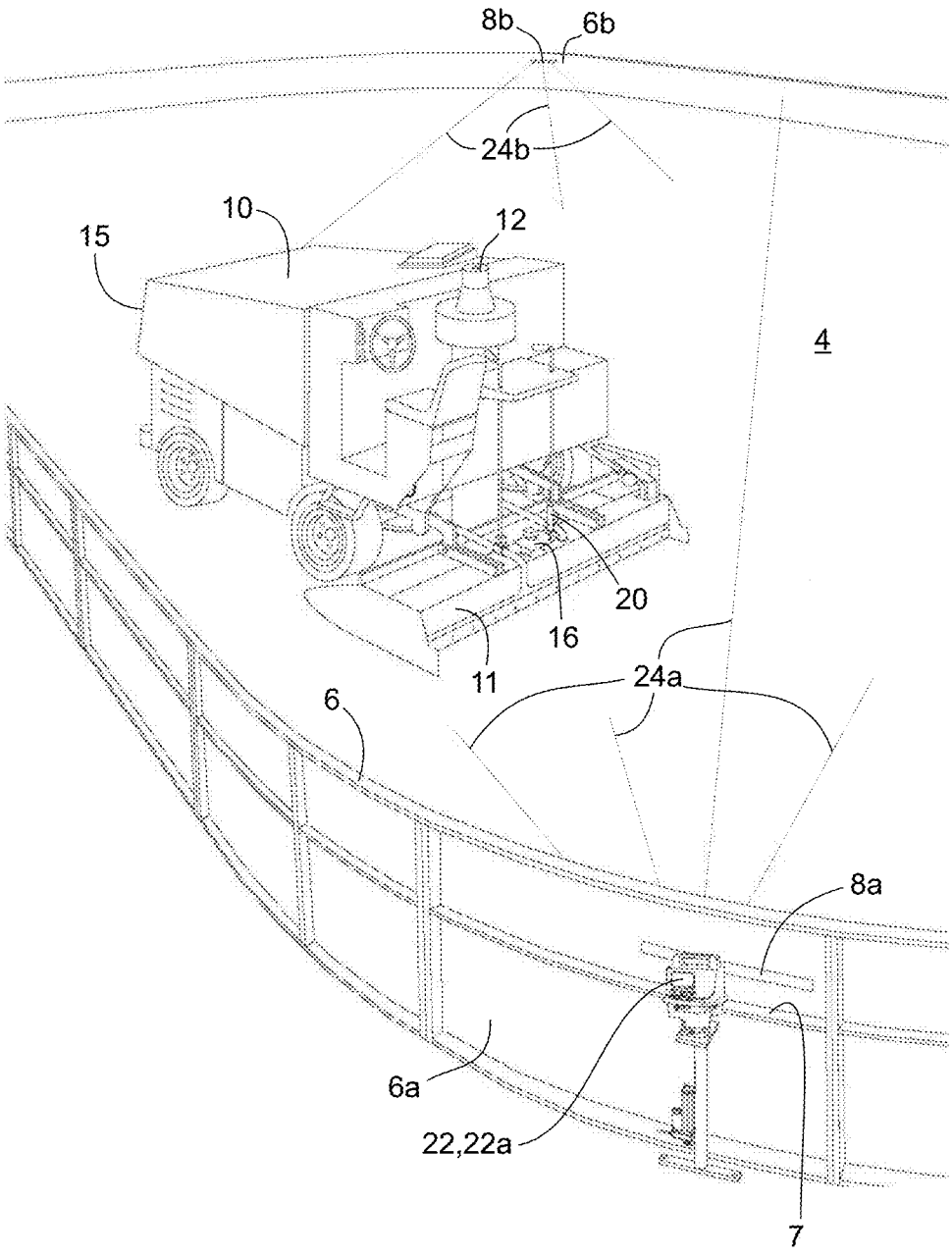
FIG. 2 depicts a perspective view of the ice leveling system of FIG. 1 in context with the ice resurfacing machine.
Figure 3:
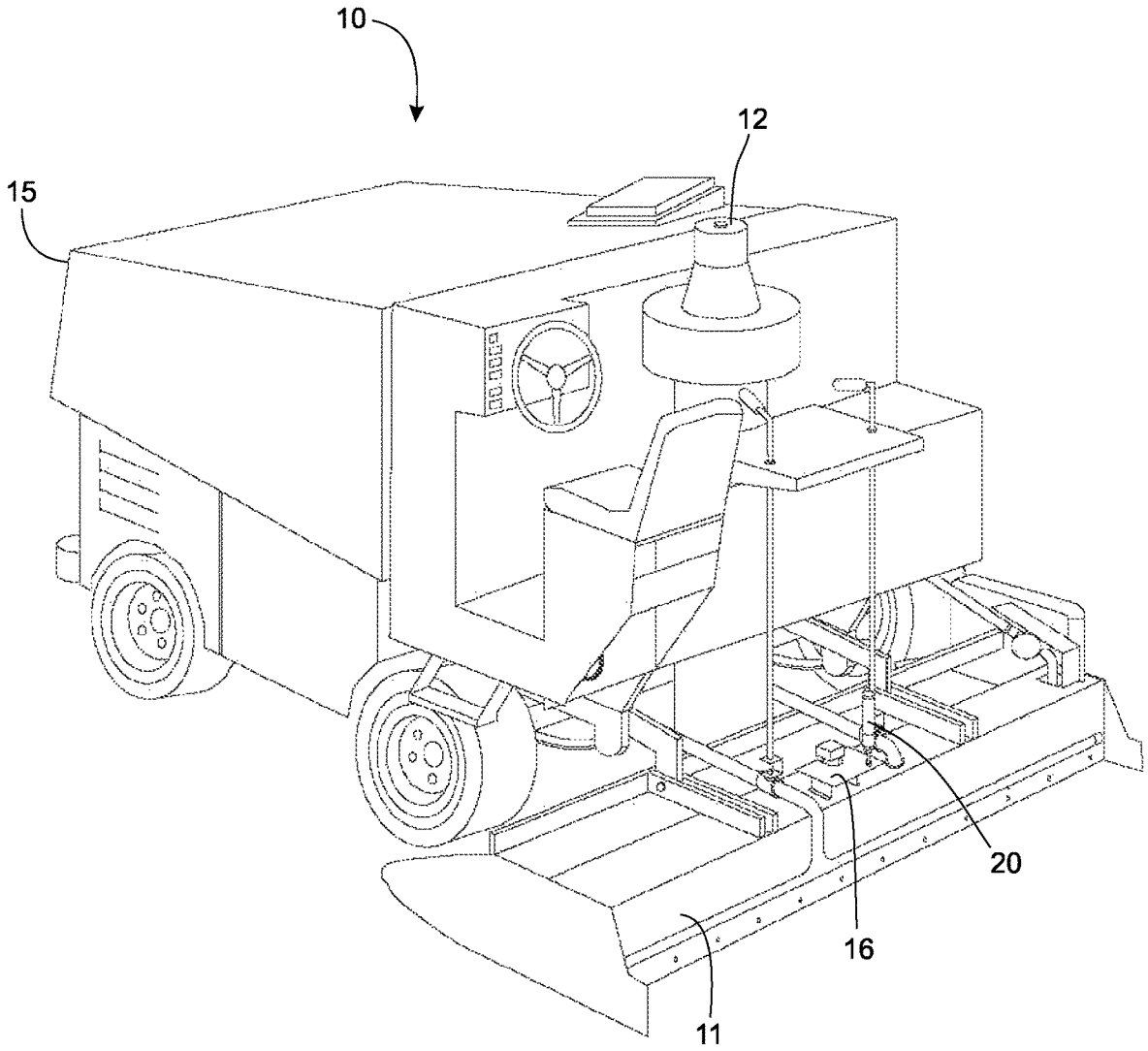
FIG. 3 depicts the ice resurfacing machine shown in FIG. 2 with a laser receiver mounted thereon.
Figure 4:
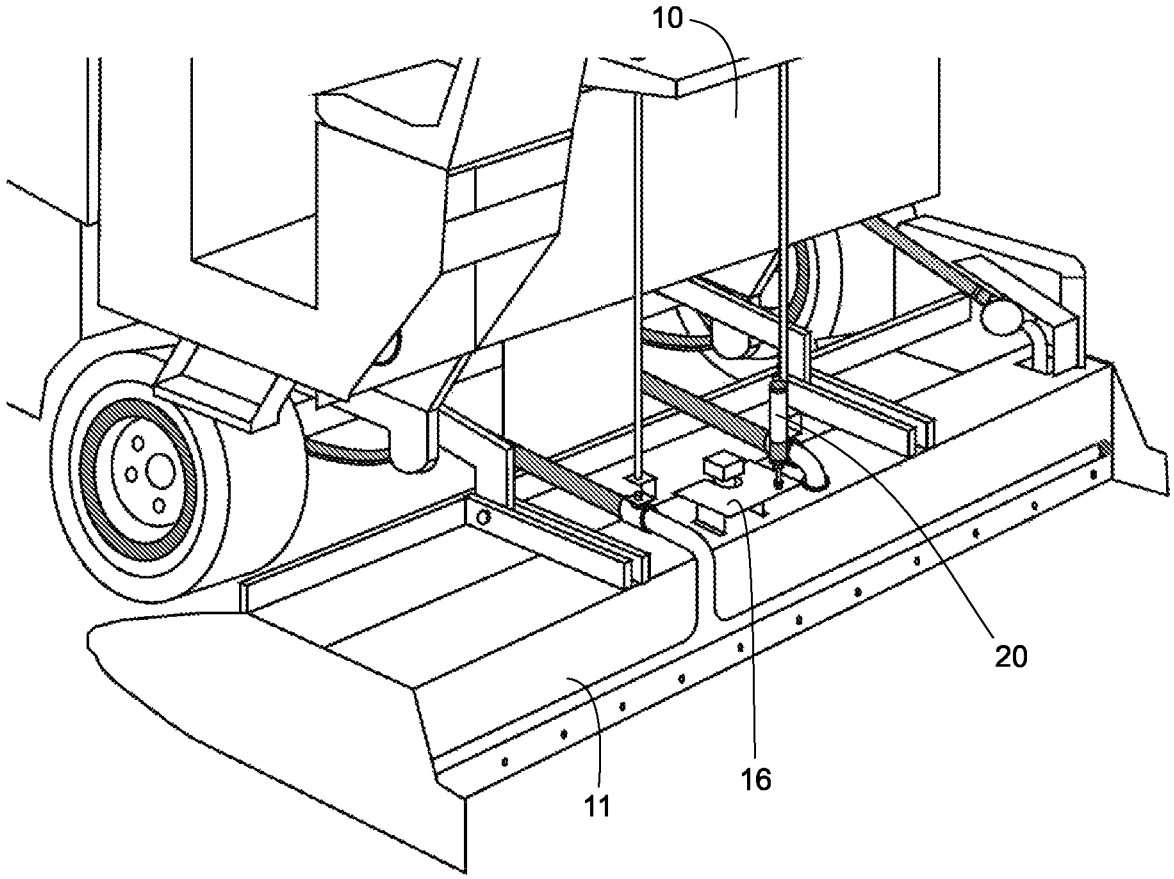
FIG. 4 depicts a magnified view of an ice conditioning head of the ice resurfacing machine shown in FIG. 3.

FIG. 1 depicts a top view of an ice leveling operation with an ice resurfacing machine 10 in a hockey rink 5 using an ice leveling system of the present invention. FIG. 1 shows the ice resurfacing machine 10 in three different locations 1, 2, 3 on an ice surface 4 of the hockey rink 5 as the ice resurfacing machine 10 is driven around the hockey rink 5. The ice surface 4 of the hockey rink 5 is bounded by a dasher board system comprising a linked series of moveable dasher boards 6 surrounding the ice surface 4.

With reference to FIG. 1, FIG. 2, FIG. 3 and FIG. 4, the ice leveling system comprises a laser receiver 20 mounted on an ice conditioning head 11 of the ice resurfacing machine 10 so that the laser receiver 20 is well below a top-most portion 12 of the ice resurfacing machine 10, which in this embodiment is the area near where sits an operator of the ice resurfacing machine 10, and is behind a front portion 15 of the ice resurfacing machine 10. For example, the laser receiver 20 may be mounted on a blade motor mount 16 of the ice conditioning head 11, but the laser receiver 20 can be mounted at any other convenient location on the ice conditioning head 11. The ice leveling system further comprises laser projectors 22, including a first laser projector 22*a* and a second laser projector 22*b* mounted behind the dasher boards 6 at diagonally opposite corners of the ice surface 4. The first laser projector 22*a* is mounted behind a first dasher board 6*a* and the second laser projector 22*b* is mounted behind a second dasher board 6*b* so that the laser projectors 22 do not extend beyond a top of the dasher boards 6. The first dasher board 6*a* has a first opening 8*a* therein and the second dasher board 6*b* has a second opening 8*b* therein to permit a first laser plane 24*a* projected by the first laser projector 22*a* to pass through the first opening 8*a* and a second laser plane 24*b* projected by the second laser projector 22*b* to pass through the second opening 8*b*. The openings 8*a*, 8*b* are preferably configured as horizontal windows. The laser planes 24*a* and 24*b* are projected parallel to the ice surface 4 in a same horizontal plane, the laser receiver 20 mounted at a height above the ice surface 4 so that the laser receiver 20 can receive laser light of the laser planes 24*a* and 24*b*. The use of two aligned laser light planes 24*a* and 24*b* allows the laser receiver 20 to receive a signal regardless of the direction of travel of the ice resurfacing machine 10, without creating a shadow blocking all of the laser planes from being received.

Because the laser receiver 20 is mounted well below a top-most portion 12 of the ice resurfacing machine 10, and in this embodiment is mounted well below most of the other portions of the ice resurfacing machine 10, the front portion 15 of the ice resurfacing machine 10 can block the laser light from one of the laser projectors 22 depending on the location of the ice resurfacing machine 10 on the ice surface 4. For this reason, at least two laser projectors 22 are required, and are required to be positioned around the ice surface 4 so that the laser receiver 20 can receive projected laser light at all times from at least one of the laser projectors 22. As can be seen from FIG. 1 and FIG. 2, when the ice resurfacing machine 10 is in location 1, the front portion 15 of the ice resurfacing machine 10 blocks the laser light projected from the second laser projector 22*b*, and when the ice resurfacing machine 10 is in location 2, the front portion 15 of the ice resurfacing machine 10 blocks the laser light projected from the first laser projector 22*a*. When the ice resurfacing machine 10 is in location 3, the laser receiver 20 can receive projected laser light from both of the laser projectors 22. Positioning the first and second laser projectors 22*a* and 22*b*, respectively, at opposite corners of the ice surface 4 permits the laser receiver 20 to see at least one of the laser planes 24*a*, 24*b* at all times.

The laser planes 24*a*, 24*b* serve as reference planes detectable by the laser receiver 20. By setting the height of the laser planes 24*a*, 24*b* at a pre-determined height, and setting the height of the laser receiver 20 to receive laser light from the laser planes 24*a*, 24*b*, the height of the ice conditioning head 11 above the ice surface 4 can be maintained at a desired level to ensure a level ice surface is made during the ice resurfacing operation.

The laser receiver 20 may be mountable directly on the ice conditioning head 11 or on a short pole or rod that is mountable on the ice conditioning head 11. The laser receiver 20 may be mountable at a fixed height above the ice conditioning head 11 or the height of the laser receiver 20 above the ice conditioning head 11 may be adjustable, preferably remotely adjustable.

Each of the laser projectors 22 may be mountable behind the dasher boards 6 at a fixed height above the ice surface 4, or the height of one or more of the laser projectors 22 above the ice surface 4 may be adjustable. Because the dasher boards 6 are moveable and the laser projectors 22 may suffer movement when not being used, it is preferable that at least one of the laser projectors 22 is height adjustable to be able to realign the laser planes if one or more of the laser projectors 22 suffer movement. Preferably, all of the laser projectors 22 are height adjustable. Preferably, height adjustment of one or more of the laser projectors 22 may be accomplished remotely.

Figure 5A:
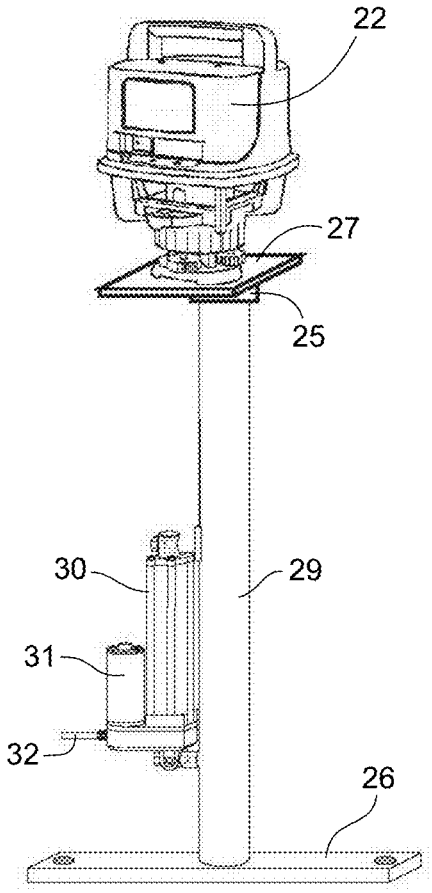
FIG. 5A depicts a laser projector on a pedestal with the pedestal retracted.
Figure 5B:
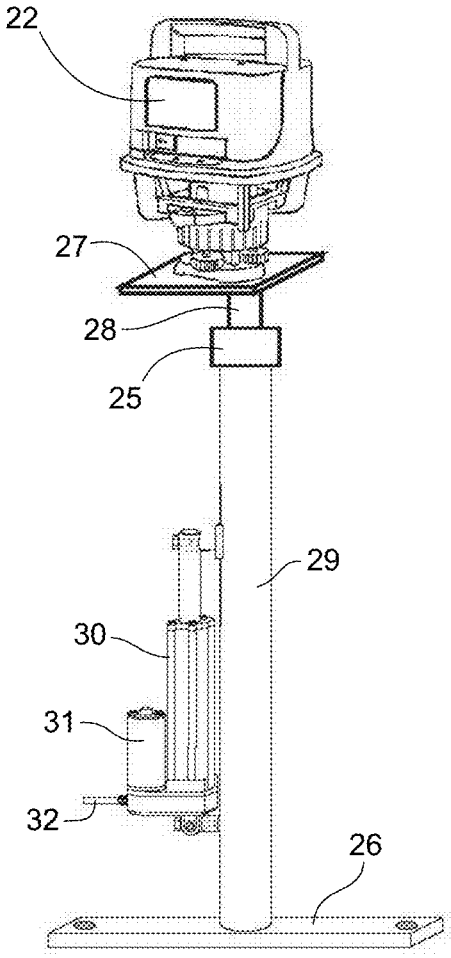
FIG. 5B depicts the laser projector on the pedestal shown in FIG. 5A with the pedestal extended.

With reference to FIG. 5A and FIG. 5B, in one embodiment of a height adjustable laser projector, the laser projector 22 is mounted on a height adjustable mount comprising a telescoping pedestal 25, the pedestal 25 supported on a base 26, which supports the pedestal 25 on the ground. The laser projector 22 is mounted directly to a support plate 27, which is mounted at an end of a longitudinally translatable inner tube 28 of the telescoping pedestal 25. A rod-in-cylinder actuator 30 is connected at one end to an outer stationary tube 29 of the telescoping pedestal 25 and at another end to the translatable inner tube 28 of the telescoping pedestal 25. Actuation of the actuator 30 causes the inner tube of the telescoping pedestal 25 to extend and retract thereby adjusting the height of the laser projector 22 between a lowered retracted position (FIG. 5A) and a raised extended position (FIG. 5B). The actuator 30 may be equipped with a motor 31. The actuator 30 and the motor 31 may be electric, hydraulic, pneumatic or of any other design. An antenna 32 in electronic communication with the motor 31 facilitates remote control of the telescoping pedestal 25.

Individual dasher boards 6 are preferably moveable and/or removeable to be able to change the configuration of the dasher boards 6 or to remove one or more dasher boards 6 entirely. The ice leveling system may further comprise at least two of the dasher boards 6 for the ice surface 4. In the illustrated embodiment, the dasher boards 6*a* and 6*b* are part of the ice leveling system. The dasher boards 6*a* and 6*b* comprise the openings 8*a* and 8*b*, respectively. The dasher boards 6*a* and 6*b* are associated with the laser projectors 22*a* and 22*b*, respectively, with the laser projectors 22*a* and 22*b* mounted behind the openings 8*a* and 8*b*, respectively. During the ice leveling operation, the laser light planes 24*a*, 24*b* are projected through the openings 8*a* and 8*b*, respectively. The laser projectors 22*a* and 22*b* are mounted with the dasher boards 6*a* and 6*b*, respectively, in a manner that allows the laser projectors 22*a* and 22*b* to be moved with the moveable dasher boards 6*a* and 6*b* when the configuration of the dasher boards 6 is changed. For example, the laser projectors 22*a* and 22*b* may be mounted on floor rails of the dasher board system. The pedestals 25 of the laser projectors 22*a* and 22*b* may be stabilized by stabilizing features of the dasher boards 6*a* and 6*b* as further described below.

Figure 6:
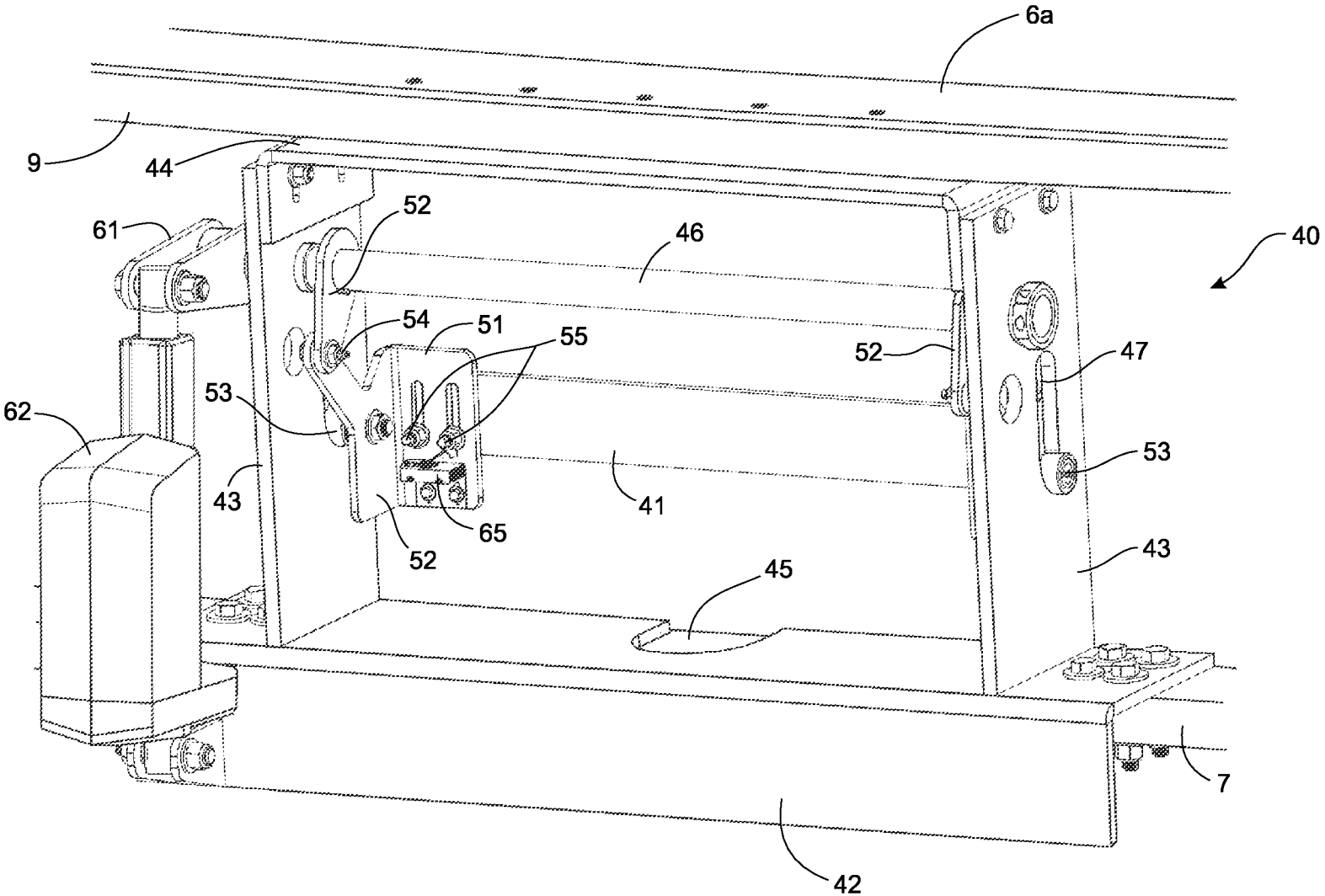
FIG. 6 depicts a rear view of a door assembly for a dasher board.
Figure 7:
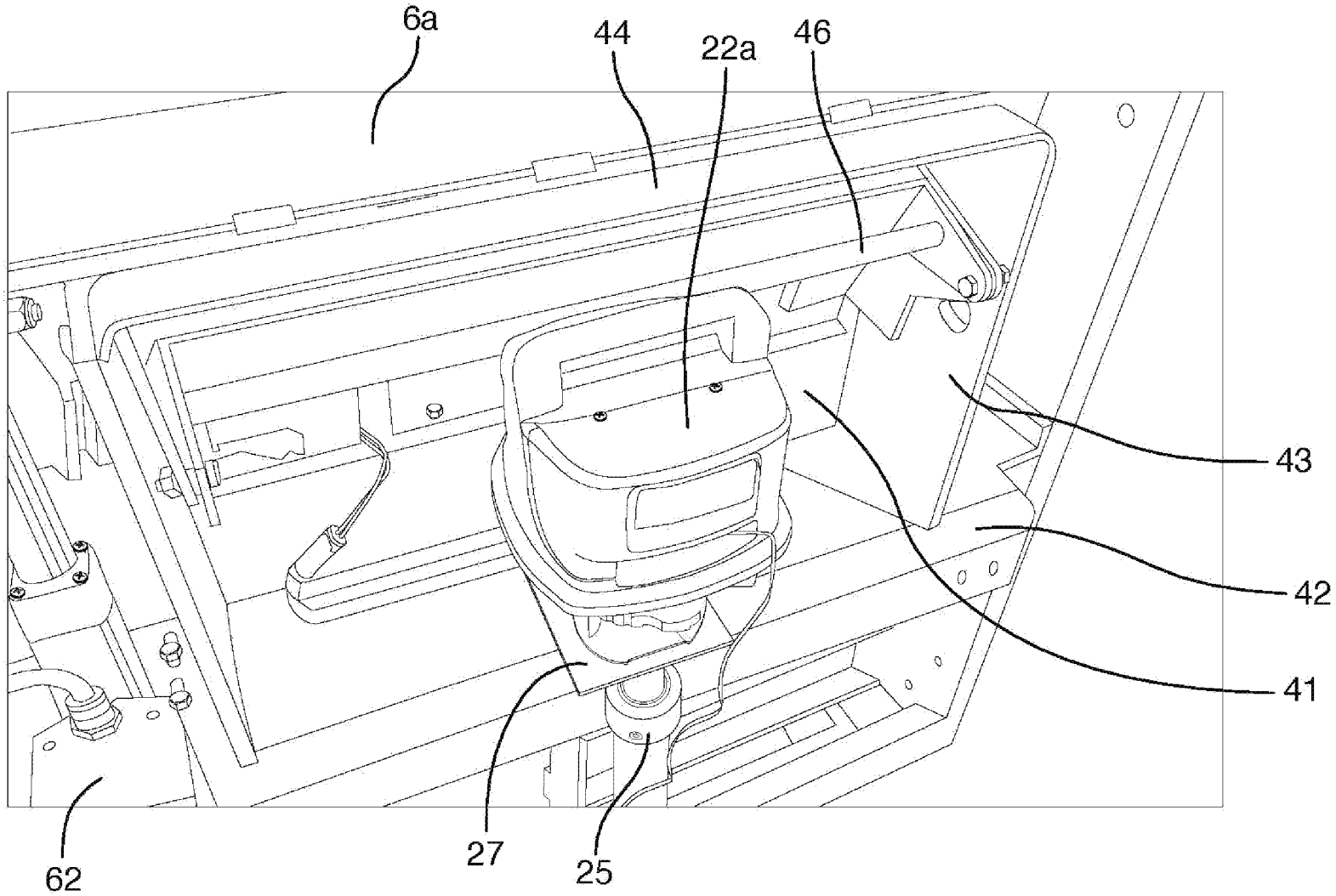
FIG. 7 depicts a rear view of the laser projector shown in FIG. 5A and FIG. 5B mounted behind the door assembly shown in FIG. 6.

The dasher boards 6*a* and 6*b* are constructed the same and in a manner to permit securely closing the openings 8*a* and 8*b* when the ice leveling system is not in use. The dasher board 6*a* is described with reference to FIG. 6 and FIG. 7, but the description applies equally to the dasher board 6*b*. The dasher board 6*a* comprises a door assembly 40 comprising a movable door plug 41 (i.e., a shutter) configured to open and securely close the opening 8*a*. The door assembly 40 is capable of withstanding impact forces of pucks, body checks, direct hits with sticks, etc. Further, providing a glass window on the opening 8*a* leads to reflection of laser light, causing inaccuracy. Therefore, the opening 8*a* is preferably unobstructed except when the door plug 41 is in place to close the opening 8*a*. When the door plug 41 is closed, the laser projector 22*a* is concealed behind the door plug 41. When the door plug 41 is opened during use of the ice leveling system, the laser projector 22*a* is able to project the laser light plane through the opening 8*a*.

The door assembly 40 comprises a frame having a lower bracket 42, two vertically extending struts 43 and an upper bracket 44 securely connected together, for example by fasteners (e.g., bolts, screws, rivets or the like), welds or the like, to form the frame. The lower bracket 42 is secured to a horizontal cross-brace 7 of the dasher board 6*a*, for example with fasteners (e.g., bolts, screws, rivets or the like), to secure the frame to the dasher board 6*a*. The lower bracket 42 is preferably L-shaped to provide better structural stability and strength to the door assembly 40 and to provide a further surface on to which other components of the door assembly 40 may be mounted. The lower bracket 42 further comprises a notch 45 to provide the telescoping pedestal 25 with enough clearance so that the telescoping pedestal 25 does not touch the dasher board 6*a*. Anything striking the dasher board 6*a* will therefore not affect delicate components of the laser projector 22*a*. The upper bracket 44 may be secured to an underside of a top brace 9 of the dasher board 6*a* by friction or fasteners (e.g., bolts, screws, rivets or the like). The vertically extending struts 43 comprise apertures through which a rotatable cross-shaft 46 is inserted and in which the cross-shaft 46 is rotatably seated. The vertically extending struts 43 also comprise L-shaped slots 47.

To open and close the door plug 41, the door plug 41 is operatively connected to the cross-shaft 46 through a pair of linkages 50, one linkage 50 secured to each end of the door plug 41. Each linkage 50 comprises a slotted mounting plate 51 whereby pins (e.g., bolts) through vertically oriented slots in the slotted mounting plate 51 secure the door plug 41 to the mounting plate 51 with securing pins 55. The securing pins 55 are able to slide vertically in the vertically oriented slots of the slotted mounting plate 51. The linkage 50 further comprises an articulated linkage arm 52 that connects the mounting plate 51 to the rotatable cross-shaft 46. The linkage arm 52 comprises a roller bearing 53. The roller bearings 53 of the pair of linkages 50 are mounted in the L-shaped slots 47 of the vertically extending struts 43 and are capable of moving within the slots 47 so that the door plug 41 is able to translate first horizontally and then vertically as the roller bearings 53 move within the slots 47 when the door plug 41 is opened and vertically then horizontally when the door plug 41 is closed. The articulated linkage arm 52 has two arm portions that are pivotally connected at a pivot pin 54 so that the two arm portions can pivot with respect to each other about the pivot pin 54. The cross-shaft 46 is connected to a crank 61, the crank 61 operatively connected to a remote controllable crank actuator 62, for example an electric linear actuator. The crank actuator 62 is mounted on the lower bracket 42. To open the door plug 41, the crank actuator 62 is operated to extend thereby causing the crank 61 to rotate upwardly thereby causing the cross-shaft 46 to rotate, which lifts the articulated linkage arm 52. As the articulated linkage arm 52 lifts, the two arm portions pivot about the pivot pin 54 decreasing an internal angle between the two arm portions, and the mounting plate 51 is lifted with the roller bearings 53 moving upwardly within the slots 47. Lifting of the mounting plate 51 lifts the door plug 41 into an opened position. To close the door plug 41, the crank actuator 62 is retracted to reverse all motions.

When remote control of the door assembly 40 fails, the door plug 41 may be opened and closed manually by disconnecting the crank 61 from the crank actuator 62 and installing a manually adjustable rod on the crank 61. The manually adjustable rod can then be operated manually to open and close the door plug 41.

Incorporated into the door assembly 40 are safety switches 65, which are part of a safety circuit 64 (see FIG. 8) to reduce the risk of objects becoming stuck in the door assembly 40 as the door plug 41 closes. The securing pins 55 are able to slide vertically in the vertically oriented slots of the slotted mounting plate 51 to provide a safety margin. When the door plug 41 starts to close, the door plug 41 closes with enough force to sever a hand, the door plug 41 being able to slide upwards preventing such an event from occurring. In the illustrated embodiment, the safety switches 65 are situated on the mounting plates 51 below the securing pins 55 and each is normally in contact with the securing pin 55 at each end of the door plug 41. When an object comes in contact with a bottom surface of the door plug 41, at least part of the door plug 41 slides upwards in relation to the slotted mounting plate 51 as indicated above because the securing pins 55 are free to move in the vertically oriented slots of the slotted mounting plate 51. As the door plug 41 slides upwards out of a normal position with respect to the mounting plate 51, the securing pins 55 in contact with the safety switches 65 lose contact with the safety switches 65, thus switching off the safety switches 65. When either of the two safety switches 65 is off, the crank actuator 62 is stopped to prevent further downward motion of the door plug 41, and the door plug 41 is controlled to open instead.

To protect the door assembly 40, as well as the laser projector 22*a* mounted on the pedestal 25, the door assembly 40 may be covered with a rear cover (not shown) so that the door assembly 40 and laser projector 22*a* are protected between the rear cover and the dasher board 6*a*. If desired, the rear cover may be open at a bottom thereof so that the laser projector 22*a* mounted on the pedestal 25 can also be encompassed by the rear cover.

Figure 8:
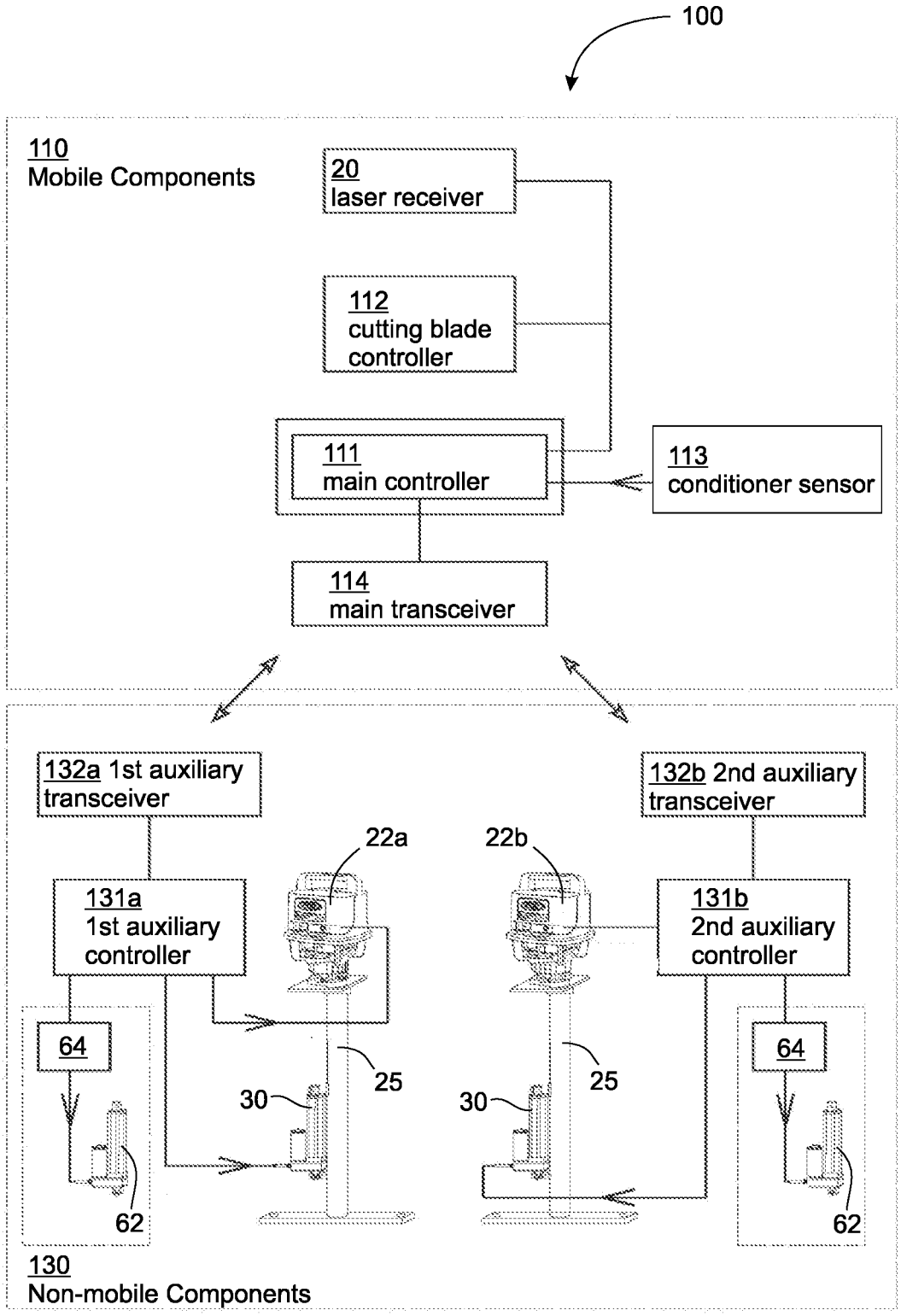
FIG. 8 depicts a schematic diagram illustrating a remote control subsystem of the ice leveling system.

With reference to FIG. 8, one embodiment of a remote control subsystem 100 for the ice leveling system of FIG. 1 comprises mobile components 110 located on the ice resurfacing machine 10 and non-mobile control components 130 located around the ice surface 4. The mobile components 110 comprise a main controller 111 in electronic communication through a twisted pair serial bus with the laser receiver 20 and a cutting blade controller 112 of the ice resurfacing machine 10, and also in electronic communication with a conditioner sensor 113 that monitors position of the cutting blade of the ice resurfacing machine 10 and a main transceiver 114, for example an XBEE radio module. The main controller 111 is preferably in wired electronic communication with the other mobile components 110, and in wireless communication through the main transceiver 114 with the non-mobile control components 130.

The non-mobile components 130 comprise all of the electronically controlled components of the laser projectors 22*a* and 22*b* and the dasher boards 6*a* and 6*b* together with a first auxiliary controller 131*a* associated with the first laser projector 22*a* and the first dasher board 6*a*, and a second auxiliary controller 131*b* associated with the second laser projector 22*b* and the second dasher board 6*b*. The non-mobile components 130 also comprise a first auxiliary transceiver 132*a* in a serial communications link with the first auxiliary controller 131*a* and a second auxiliary transceiver 132*b* in a serial communications link with the second auxiliary controller 131*b*. The first auxiliary controller 131*a* is in electronic communication (either wired or wirelessly) with the electronically controlled components of the first laser projector 22*a* and the first dasher board 6*a*. The second auxiliary controller 131*b* is in electronic communication (either wired or wirelessly) with the electronically controlled components of the second laser projector 22*b* and the second dasher board 6*b*. The first auxiliary transceiver 132*a* and the second auxiliary transceiver 132*b* are in wireless electronic communication with main transceiver 114 so that commands can be transmitted from the main controller 111 to the first and second auxiliary controllers 131*a* and 131*b*, respectively, and so that data can be transmitted from the auxiliary controllers 131*a* and 131*b* back to the main controller 111.

The main controller 111 preferably comprises a programmable logic controller programmed to automatically control the height of the laser projectors 22*a*, 22*b* by controlling the actuators 30, through the first and second auxiliary controllers 131*a*, 131*b*, based on signals received by the laser receiver 20 in order to keep the laser planes 24*a*, 24*b* aligned with each other and with the laser receiver 20. The main controller 111 is also preferably programmed to switch the laser projectors 22*a*, 22*b* on and then off, through the first and second auxiliary controllers 131*a*, 131*b*, when the ice leveling system is switched on and then switched off. The main controller 111 is also preferably programmed to open and then close the door plugs 41, through the first and second auxiliary controllers 131*a*, 131*b*, when the ice leveling system is switched on and then switched off. Further, based on data from the conditioner sensor 113 and the laser receiver 20, the main controller 111 preferably automatically controls the cutting blade controller 112 to adjust the cutting blade to the optimal height from the ice surface 4 to ensure that ice surface 4 is level after the ice resurfacing operation. Any one or more of these tasks may instead be done by operator intervention.

The safety circuit 64 is an important part of the remote control subsystem 100. With reference to the first dasher board 6*a*, when one or both of the safety switches 65 are tripped, the first auxiliary controller 131*a* automatically instructs the crank actuator 62 to stop. The following logic is programmed into the first auxiliary controller 131*a*.

1. When an object blocks the downward movement of the door plug 41, the door plug 41 will move upward and switch at least one of the safety switches 65 off.
2. The crank actuator 62 stops the downward movement of the door plug 41 in response to the safety switch 65 turning off.
3. The crank actuator 62 reverses to lift the door plug 41 again until the door plug 41 opens fully.
4. After 20 seconds, a signal is sent by the first auxiliary controller 131*a* to the crank actuator 62 to retract to attempt to lower the door plug 41 again. If the door plug 41 has not been adjusted back into place, the safety switches 65 will remain open (off) and the door plug 41 will not lower.
   a. To adjust the safety switches 65 back into place, the door plug 41 is manually moved downward until the door plug 41 is sitting in the bottom of slots of the slotted mounting plate 51 and cannot move any further, thereby ensuring that the safety switches 65 switch on and allow the door plug 41 to close when the time limit is over.
5. After the safety switches 65 have been reset, the door plug 41 begins to close.
6. If the path of the door plug 41 is not interrupted again, the door plug 41 will close successfully.

If the door plug 41 remains pushed upward in the slots of the slotted mounting plate 51 for more than 20 seconds, the door plug 41 stays open indefinitely. When the door plug 41 is manually fixed into proper place by following the step '4*a*' above, the control subsystem 100 has to be cycled to 'ON' mode, which commands both auxiliary controllers 131*a* and 131*b* to automatically open the door plug 41 restoring a normal operating state. Turning the system switch of the main controller 111 back to a position marked 'Down' commands both auxiliary controllers 131*a* and 131*b* to lower the door plug 41. The door plug 41 will lower normally, provided the safety switches 65 are in the correct position with the door plug 41 all the way to the bottom of the slots in the slotted mounting plate 51.

The novel features will become apparent to those of skill in the art upon examination of the description. It should be understood, however, that the scope of the claims should not be limited by the embodiments but should be given the broadest interpretation consistent with the wording of the claims and the specification as a whole.

The invention claimed is:

1. An ice leveling system comprising:

a laser receiver mountable on an ice conditioning head of an ice resurfacing machine below a top-most portion of the ice resurfacing machine;

at least two laser projectors that project laser light in a plane below a level of the top-most portion of the ice resurfacing machine, the at least two laser projectors mountable adjacent to an ice surface to be leveled, the at least two laser projectors positionable around the ice surface so that the laser receiver when mounted on the ice resurfacing machine always receives the laser light from at least one of the at least two laser projectors during an ice leveling operation with the ice resurfacing machine, at least one of the at least two laser projectors being a height adjustable laser projector to align the laser light plane projected by the height adjustable laser projector with the laser light plane of others of the at least two laser projectors; and, at least two dasher boards for the ice surface, each of the dasher boards comprising:

an opening through which the laser light plane is projectable from one of the at least two laser projectors during the ice leveling operation; and, a movable door plug configured to open and securely close the opening.

2. The system of claim 1, wherein the at least two laser projectors comprise two laser projectors.

3. The system of claim 2, wherein both of the two laser projectors are height adjustable.

4. The system of claim 1, wherein the height adjustable laser projector is height adjustable by being mounted on a height adjustable mount comprising a telescoping pedestal, the telescoping pedestal operated by an actuator mounted on the pedestal.

5. The system of claim 1, wherein the at least two laser projectors are mounted adjacent the at least two dasher boards so that the laser light planes are projectable from the laser projectors toward the laser receiver through the openings when the door plugs are opened.

6. The system of claim 1, further comprising a remote controller configured to automatically control a height of the height adjustable laser projector above the ice surface in order to align the laser light planes projected by all of the laser projectors with each other and with the laser receiver.

7. The system of claim 1, further comprising a remote controller configured to automatically control a height of the height adjustable laser projector above the ice surface in order to align the laser light planes projected by all of the laser projectors with each other and with the laser receiver and to automatically open and close the door plugs.

8. The system of claim 1, wherein the at least two laser projectors comprise a first laser projector and a second laser projector, and the first laser projector is mounted at a first corner of the ice surface diagonally opposite the second laser projector mounted at a second corner of the ice surface.

9. A method for leveling ice on an ice surface to be leveled comprising:

operating an ice resurfacing machine on the ice surface to be leveled, the ice resurfacing machine having a laser receiver mounted on an ice conditioning head of the ice resurfacing machine below a top-most portion of the ice resurfacing machine;

projecting at least two aligned laser light planes horizontal to the ice surface in a plane below a level of the top-most portion of the ice resurfacing machine, the laser light from at least one the laser light planes being received by the laser receiver irrespective of the position and orientation of the ice resurfacing machine on the ice surface; and, controlling a height of the ice conditioning head during operation of the ice resurfacing machine so that the laser receiver is always receiving the laser light from at least one of the planes of the projected laser light, wherein the laser light planes are projected through openings in dasher boards around the ice surface and opening and closing of the openings are remote controlled.

10. The method of claim 9, further comprising adjusting a height of at least one of the at least laser light planes so that the at least two aligned laser light planes are aligned horizontally.

11. The method of claim 9, wherein at least two of the laser light planes are projected from diagonally opposite corners of the ice surface.

* * * * *